US011214995B2

(12) United States Patent
Schiffer et al.

(10) Patent No.: US 11,214,995 B2
(45) Date of Patent: Jan. 4, 2022

(54) SAFETY DEVICE FOR A MOTOR VEHICLE, HAVING A ROTARY LATCH AND A PRE-LATCHING POSITION AND A MAIN LATCHING POSITION

(71) Applicant: Kiekert AG, Heiligenhaus (DE)

(72) Inventors: Holger Schiffer, Meerbusch (DE); Michael Scholz, Essen (DE); Thomas Schönenberg, Burscheid (DE); Ömer Inan, Dorsten (DE)

(73) Assignee: Kiekert AG, Heiligenhaus (DE)

( * ) Notice: Subject to any disclaimer, the term of this patent is extended or adjusted under 35 U.S.C. 154(b) by 644 days.

(21) Appl. No.: 16/064,547

(22) PCT Filed: Nov. 24, 2016

(86) PCT No.: PCT/DE2016/100547
§ 371 (c)(1),
(2) Date: Jun. 21, 2018

(87) PCT Pub. No.: WO2017/108021
PCT Pub. Date: Jun. 29, 2017

(65) Prior Publication Data

US 2019/0003217 A1 Jan. 3, 2019

(30) Foreign Application Priority Data

Dec. 22, 2015 (DE) ..... 10 2015 122 575.1

(51) Int. Cl.
*E05B 85/26* (2014.01)
*E05B 83/24* (2014.01)
(Continued)

(52) U.S. Cl.
CPC ..... *E05B 85/26* (2013.01); *E05B 83/24* (2013.01); *E05B 81/14* (2013.01); *E05B 2015/0486* (2013.01)

(58) Field of Classification Search
CPC ..... E05B 83/24; E05B 85/26; E05B 81/14
See application file for complete search history.

(56) References Cited

U.S. PATENT DOCUMENTS

| | | | | |
|---|---|---|---|---|
| 5,163,723 | A | 11/1992 | Rückert | |
| 2014/0361554 | A1 | 12/2014 | Ferri et al. | |
| 2018/0371804 | A1 * | 12/2018 | Inan | E05B 77/08 |

FOREIGN PATENT DOCUMENTS

| | | | | |
|---|---|---|---|---|
| DE | 2839070 | A1 | 4/1979 | |
| DE | 2839070 | A1 * | 4/1979 | E05B 85/26 |

(Continued)

OTHER PUBLICATIONS

Translation of Japanese Office Action dated Jul. 21, 2020, for related Japanese National Phase Patent Application No. 2018-532750.

(Continued)

*Primary Examiner* — Kristina R Fulton
*Assistant Examiner* — James Edward Ignaczewski
(74) *Attorney, Agent, or Firm* — Renner, Otto, Boisselle & Sklar, LLP

(57) ABSTRACT

A safety device for a motor vehicle, having a lock holder, a pawl and a rotary latch, wherein the rotary latch has a load arm, a catch arm, an opening direction of rotation, a closing direction of rotation, a pre-latching position and a main latching position, wherein the pawl is latched in on the catch arm in the pre-latching position and is latched in on the load arm in the main latching position.

9 Claims, 4 Drawing Sheets

Figure 1A:
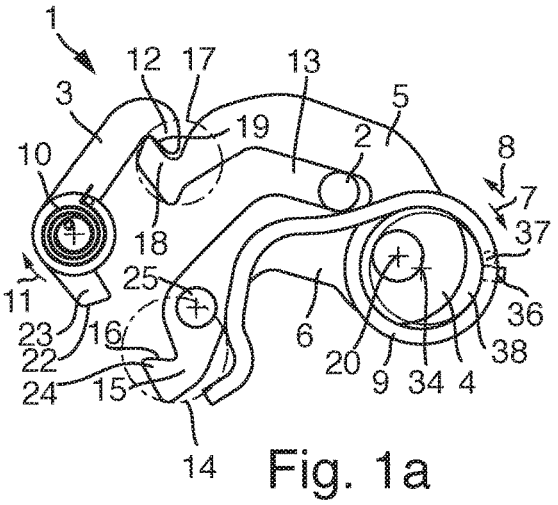
Figure 1B:
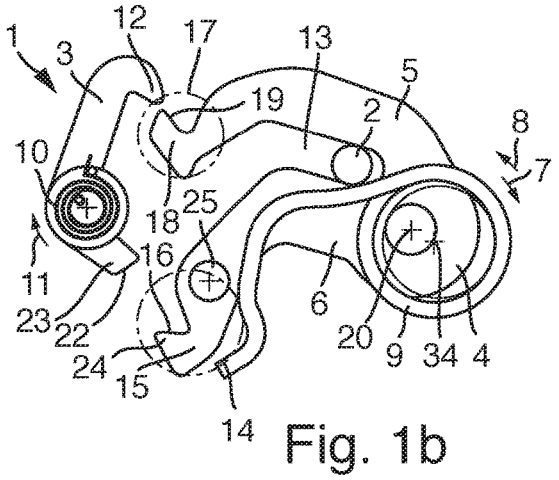

(51) Int. Cl.
*E05B 81/14* (2014.01)
*E05B 15/04* (2006.01)

(56) References Cited

FOREIGN PATENT DOCUMENTS

| | | | | | |
|---|---|---|---|---|---|
| DE | 3126810 | A1 * | 2/1983 | ..... | E05B 85/045 |
| DE | 3126810 | A1 | 2/1983 | | |
| DE | 19902561 | | 8/2000 | | |
| DE | 19902561 | A1 * | 8/2000 | ..... | E05B 77/06 |
| DE | 19929103 | | 12/2000 | | |
| DE | 202008000560 | | 3/2008 | | |
| DE | 102007045716 | | 4/2008 | | |
| DE | 102009037037 | | 2/2011 | | |
| DE | 102009037037 | A1 * | 2/2011 | ..... | E05B 85/26 |
| DE | 19937405 | | 6/2011 | | |
| DE | 102010062700 | | 6/2012 | | |
| DE | 102010062700 | A1 * | 6/2012 | ..... | E05B 83/24 |
| DE | 102011003808 | A1 | 8/2012 | | |
| DE | 102011003808 | A1 * | 8/2012 | ..... | E05B 83/24 |
| DE | 102011121542 | A1 * | 6/2013 | ..... | E05B 79/20 |
| DE | 102011121542 | A1 | 6/2013 | | |
| DE | 102012004792 | A1 * | 9/2013 | ..... | E05B 83/26 |
| JP | H05214863 | A | 8/1993 | | |
| JP | 2013117115 | A | 6/2013 | | |
| JP | 2014101687 | A | 6/2014 | | |

OTHER PUBLICATIONS

International Search Report and Written Opinion for corresponding Patent Application No. PCT/DE2016/100547 dated Feb. 13, 2017.

* cited by examiner

SAFETY DEVICE FOR A MOTOR VEHICLE, HAVING A ROTARY LATCH AND A PRE-LATCHING POSITION AND A MAIN LATCHING POSITION

The invention relates to a safety device for a motor vehicle which has a lock holder, a pawl and a rotary latch, whereby the rotary latch has a load arm, a catch arm, an opening direction of rotation, a closing direction of rotation, a pre-latching position and a main ratchet position.

Such a safety device is known from DE 10 2007 045 716 A1. Therein a rotary latch with a load arm and a catch arm and a ratchet position is described, where a pawl encompasses the rotary latch in the ratchet position of the rotary latch on the load arm. Furthermore, a safety device according to the generic term is known from DE 20 2008 000 560 U1. The described hood lock has a rotary latch with a pre-latching position and a main ratchet position, where the pawl is ratcheted to the catch arm of the rotary latch in the pre-latching position and in the main ratchet position. DE 199 29 103 A1 reveals a safety device according to the generic term, whereby in this safety device the pawl is also ratcheted in the pre-latching position and also in the main ratchet position of the rotary latch on the catch arm of the rotary latch. In DE 199 37 405 B4 a safety device is described according to the generic term in which, instead of a simple pawl, a ratchet pawl ratcheted in the main ratchet position of the rotary latch on the external circumference of the catch arm of the rotary latch and in the pre-latching position of the rotary latch is provided for on the external circumference of the catch arm of the rotary latch.

The disadvantage of the aforementioned safety devices according to DE 20 2008 000 560 U1 and DE 199 29 103 A1 consists therein, that for providing a first and second ratcheting area on the external circumference of the catch arm of the rotary latch for ratcheting of the pawl in the pre-latching position and the main ratchet position of the rotary latch respectively in a relatively large distance to the pivot point of the rotary latch considerable material use is provided for. A position of the respective ratcheting areas in a relatively far distance to the pivot point of the rotary latch is desirable therein that a load of the pawl in the case of securing against unwanted opening is as low as possible both in the pre-latching position and the main ratchet position. A comparatively high material cost to execute a ratcheting area for the pre-ratchet and main ratchet position of the rotary latch can have a disadvantageous effect on the overall weight of the safety device, however. Execution of a pre-latching position and a main ratchet position of a rotary latch according to DE 199 37 405 B4 with a pawl and an additional ratchet pawl also has the disadvantage of an additional component and thus an increased overall weight of the safety device. An increased overall weight of the safety device has a disadvantageous effect on the fuel consumption of a motor vehicle in which the safety device is installed.

The object of the present invention is therefore to provide a safety device according to the generic term in which an overall weight of the safety device is reduced.

This task is solved according to the invention by means of a safety device with the characteristics of patent claim 1 and a procedure with the characteristics of patent claim 10. Advantageous designs with expedient further formations of the invention result from the remaining patent claims, the description and the figures. In particular, one or several characteristics from the independent claim and the dependent claims can also be supplemented and/or replaced by one or several characteristics from the description. One or several characteristics from respectively different configurations of the invention can also be associated with further formations of the invention.

In order to create a safety device which has a comparatively lighter overall weight compared to a previously known safety device, a safety device for a motor vehicle is proposed which has a lock holder, a pawl and a rotary latch, where the rotary latch has a load arm, a catch arm, an opening direction of rotation, a closing direction of rotation, a pre-latching position and a main ratchet position and the pawl is ratcheted in the pre-latching position of the rotary latch on the catch arm and in the main ratchet position on the load arm.

In the main ratchet position of the rotary latch, the safety device assumes a bolting position, where the load arm blocks the rotary latch in the opening direction of rotation. In the main ratchet position, a stop preferably prevents excessive rotation of the rotary latch in the closing direction of rotation, where slight play can be provided for between this stop and the rotary latch in the main ratchet position of the rotary latch. Starting from the bolting position of the safety device, the safety device can preferably be unbolted only from inside the motor vehicle or by means of remote control. In particular, the safety device cannot be manually loosened in the bolting position in an area around a front hood for which the safety device is preferably provided for.

In the pre-latching position of the rotary latch the lock holder is unbolted from the bolting position and blocked in an opening movement direction by means of the load arm. In the pre-latching position of the rotary latch the safety device can preferably be loosened manually in the area around the front hood, whereby the loosened safety device unblocks a movement of the lock holder in the opening movement direction.

The pre-latching position of the rotary latch serves to arrest the front hood, a door or a flap in an installed state of the safety device if the main ratchet position of the rotary latch is not attained upon closure. Furthermore, the pre-latching position of the rotary latch serves to provide an intermediate position during opening of the safety device between the bolting position of the safety device and an open position of the safety device in which the lock holder is unblocked in the opening movement direction. Such an intermediate position of the safety device increases the safety to the extent that in the case of accidental unbolting of the safety device the lock holder is not yet unblocked in the opening movement direction, but that the blockade of the lock holder needs to be loosened by a further manual operation.

The catch arm and the load arm form a fork-shaped infeed section of the rotary latch which accommodates the lock holder during a closure process of the rotary latch. The catch arm and the load arm respectively have a head area, where both head areas are advantageously the areas of the rotary latch furthest from a rotational axis of the rotary latch. Both head areas form an opening of the infeed section into which the lock holder enters during the closure process of the rotary latch. The head areas can preferably respectively extend up to one fifth of a length of the catch arm or the load arm from the respective end of the catch arm or the load arm to the rotational axis of the rotary latch.

The load arm and the catch arm are preferably formed at least partially arch-shaped in order to enable guidance of the lock holder within the infeed section during a closure movement of the rotary latch.

An especially advantageous configuration of the invention provides for the head area of the catch arm having a tangent bending with a ratcheting surface in the direction of the opening direction of rotation. A ratchet nose of the pawl lies on the ratcheting surface in the pre-latching position of the rotary latch and encompasses the tangent bending of the catch arm, whereby the pawl is acted on by means of a pawl spring of the safety device into a locking rotational direction and assumes a locking position. Furthermore and first and foremost in combination with this configuration, a further design can be provided for in which the head area of the load arm has a tangent bending with a ratchet surface in the direction of the opening direction of rotation. In the main ratchet position of the rotary latch the ratchet nose of the pawl lies adjacent to the ratchet surface, where the ratchet nose encompasses the tangent bending of the load arm and the pawl assumes the locked position.

In particular, the combination of these two configurations enables the pawl to be ratcheted directly in the area of the opening of the infeed section both in the pre-latching position and also in the main ratchet position of the rotary latch and the pawl is secured against a rotation into the opening direction of rotation. A rotary latch spring of the safety device acts on the rotary latch in the opening direction of rotation and presses the respective ratchet surfaces in an opening direction of rotation against the ratchet nose of the pawl. The rotary latch spring is preferably formed as a leg spring. The rotary latch can be loosened by means of a rotation of the pawl against the locking direction of rotation from the pre-latching position and from the main ratchet position. As soon as the rotary latch can be passed in the opening direction of rotation on the ratchet nose of the pawl, the pawl is located in a release position. The rotary latch spring can drive the rotary latch in the opening direction of rotation in the release position and/or eject the lock holder from the rotary latch.

As the respective head areas of the catch arm and the load arm constitute the areas of the rotary latch the furthest from a pivot axis of the rotary latch and the pawl is ratcheted in the pre-latching position on the bending tangent of the catch arm or in the main ratchet position on the bending tangent of the load arm, the largest possible torque effect of the pawl is provided for against an opening rotational moment of the rotary latch, for example in the case of an accident in the pre-latching position and in the main ratchet position.

Compared to the safety devices described in the state of the art in which the pawl is not directly ratcheted in the area of an opening of the infeed section both in the pre-latching position and also in the main ratchet position of the rotary latch, this has the advantage that the rotary latch does not need to extend in the areas far from the opening of the infeed section in order to form a ratchet surface to accommodate the ratchet nose of the pawl respectively. An external contour of the catch arm can thus predominantly run in parallel to an internal contour of the infeed section, where this is a further preferred configuration of the safety device. This reduces the weight of the rotary latch and thus the overall weight of the safety device, whereby fuel consumption of a motor vehicle in which the safety device can be installed can be reduced.

The pawl spring and the rotary latch spring respectively have spring stiffness, where in an especially advantageous embodiment the spring stiffness of the pawl spring is adjusted to the spring stiffness of the rotary latch spring such that during unsecuring of the rotary latch from the main ratchet position ratcheting of the rotary latch into the pre-latching position is ensured. The spring stiffness of the pawl spring is adjusted with particular preference to the spring stiffness of the rotary latch spring, the mass inertia moment of the pawl around a rotational axis of the pawl, the mass inertia moment of the rotary latch around the rotational axis of the rotary latch and to a weight force of the front hood acting on the rotary latch by means of the lock holder such that during unsecuring of the rotary latch from the main ratchet position the pawl has greater rotational acceleration than the rotary latch and ratcheting of the rotary latch into the pre-latching position is ensured. Such an adjustment of the spring stiffness of the pawl spring enables the pawl to reach the locked position after unsecuring of the rotary latch from the main ratchet position more quickly than the rotary latch reaches the pre-latching position so that in the case of unsecuring of the rotary latch from the main ratchet position ratcheting into the pre-latching position is ensured.

Within the scope of a further configuration or combined with the previous configuration, it is provided for that the safety device has a delay mechanism to delay the rotary latch. During rotation of the rotary latch in the opening direction of rotation starting from the main ratchet position, the delay mechanism ensures ratcheting of the rotary latch in the pre-latching position. In this embodiment, a longer time is available, within which the pawl can reach the locking position before the rotary latch assumes the pre-latching position. The advantage of this variant is that adjustment of the spring stiffness of the pawl spring to the spring stiffness of the rotary latch spring can be dispensed with and, nevertheless, ratcheting of the rotary latch in the pre-latching position can be ensured during rotation of the rotary latch in the opening direction of rotation, starting from the main ratchet position. In particular, a pawl spring can thus have smaller dimensions which also reduces the overall weight of the safety device. The delay mechanism can be executed in the form of a friction surface, for example, which decelerates the rotary latch before reaching the pre-latching position.

Within the scope of a preferred variant, the delay mechanism has a stop surface to stop the rotary latch. The stop surface can be arranged on a boom of the pawl, for example, and interact with the bending tangent of the catch arm. Equally, the stop surface on the catch arm, preferably on the bending tangent of the catch arm can be arranged and interact with the boom of the pawl. It is crucial in this embodiment that in the release position of the pawl a trajectory of a point of the catch arm furthest from the pivot axis of the rotary latch intersects the boom, i.e. the boom blocks the catch arm during rotation of the rotary latch from the main ratchet position to the pre-latching position in an intermediate position between the main ratchet position and the pre-latching position of the rotary latch. If the rotary latch is located in the intermediate position, this enables a movement of the pawl driven by the pawl spring from the release position to reaching of the locked position before the catch arm can pass the ratchet nose of the pawl.

An advantageous configuration of the safety device envisages that the pawl has a first active surface and the catch arm has a countersurface and the first active surface interacts with the countersurface of the catch arm during rotation of the rotary latch in the closing direction of rotation before reaching the pre-latching position. The countersurface of the catch arm preferably impacts the active surface during rotation of the rotary latch in the closing direction of rotation and shifts the pawl in the direction of the release position.

Equally advantageously, it can be provided for that the load arm has a countersurface and the first active surface interacts with the countersurface of the load arm during closure of the rotary latch before reaching the main ratchet position. The countersurface of the catch arm preferably impacts the active surface during rotation of the rotary latch in the closing direction of rotation and shifts the pawl in the direction of the release position.

In a further formation, the pawl has a second active surface which interacts with the countersurface of the load arm during closure of the rotary latch before reaching the main ratchet position. A gradient of the first active surface is preferably different to a gradient of the second active surface, where during gliding of the countersurface of the catch arm to the first active surface a different relative speed of the catch arm is caused in relation to the pawl compared to a relative speed of the load arm in relation to the pawl during gliding of the countersurface of the load arm on the second active surface.

An advantageous further formation envisages that the rotary latch spring is formed as a spiral spring. This can enable in particular a narrower design of the safety device compared to a safety device in which the rotary latch spring is executed as a leg spring. The configuration of the rotary latch spring as a spiral spring can simplify in particular joint accommodation of the rotary latch and the rotary latch spring on a common pivot axis, where this joint accommodation illustrates a further possible embodiment of the safety device. The narrower design of the rotary latch spring is hereby advantageous in particular as a spiral spring compared to a leg spring, because bearings can be arranged in a bearing pairing for the joint pivot axis and thus the pivot axis can be shorter and a higher bearing load of the pivot axis is enabled to accommodate more than one component.

In a preferred configuration, it is provided for that the rotary latch spring has a leg with at least one section, where the section has an almost horizontal alignment in the main ratchet position and lies adjacent to the lock holder. The alignment is specified by means of a connecting line between a start and an end of the section, where the section extends along the leg.

The almost horizontal alignment of the section of the leg in the main ratchet position relates in particular to a state of the safety device in which it is installed into a motor vehicle. In the installed state, an exactly horizontal line runs parallel to a vehicle lengthwise axis of the motor vehicle. Almost horizontal means that the connecting line includes an angle of at least less than 20 degrees, preferably less than 15 degrees, with the motor vehicle lengthwise axis. Especially advantageously, the horizontal section of the leg borders a coil of the rotary latch spring. The almost horizontal alignment of the section of the leg in the main ratchet position can cause a normal force acting from the leg to the lock holder during initial rotation of the leg, almost vertical, in particular vertical to the motor vehicle lengthwise axis aligned upwards and acts almost the entire normal strength against a weight force transferred via the latch holder. This can enable the rotary latch spring to drive the rotary latch in the opening direction of rotation and it can preferably be of smaller dimensions to eject the lock holder.

Furthermore, a method to open the safety device is proposed, where the method has the following steps. In a first step, the pawl is deflected from the locking position. The deflection occurs until the pawl has reached the release position. Deflection of the pawl can be caused by means of an electromotor, for example. In a second step, the rotary latch is rotated in the opening direction of rotation starting from the main ratchet position, whereby this is supported by means of the rotary latch spring. The rotary latch is delayed in a third step. This can occur by means of deceleration of the rotary latch in the closing direction of rotation and/or advantageously by means of a stopping of the rotary latch on the stop surface of the pawl boom. After deflection of the pawl, the pawl is moved in the direction of the locked position in a fourth step. The pawl is preferably driven by the pawl spring. Ratcheting of the rotary latch is provided for in the pre-latching position in a fifth step. This is enabled in particular by the pawl reaching the locked position before the rotary latch assumes the pre-latching position. The sequence of the individual steps of the procedure stated here is a preferred sequence. It is also possible that the rotary latch is delayed after initial movement of the pawl in the direction of the locked position.

In a parallel patent application of the same applicant with the title "Safety device for a motor vehicle with a rotary latch and an ejection spring", the content of which is also fully made into the object of the original publication of this application with its described technical characteristics, a safety device is described with a change of adjacency a leg of an ejection spring. First and foremost, the technical characteristics described in the parallel patent application which enable a change of adjacency of the leg from the lock holder to the rotary latch, increase of a relative stroke section of the lock holder and reduction of the relative stroke section of the lock holder to the original publication of this application. This affects in particular the configuration of the rotary latch spring as an ejection spring and the geometric configuration of the leg of the ejection spring.

In a further parallel patent application of the same applicant with the title "Safety device for a motor vehicle with a rotary latch and a protective layer", the content of which is also fully made into the object of the original publication of this application with its described technical characteristics, a safety device is described with a blocking element to block a rotary latch in a closing direction of rotation. First and foremost, the technical characteristics described in the parallel patent application which increase the safety of the safety device pertain to the original disclosure of this application. This affects in particular the configuration of the blocking element and the interaction of the blocking element with the pawl and the rotary latch.

Other advantages, characteristics and details of the invention result from the following description, at least of a preferred exemplary embodiment to which the invention is not restricted, however, and on the basis of the figures.

Figure 3:
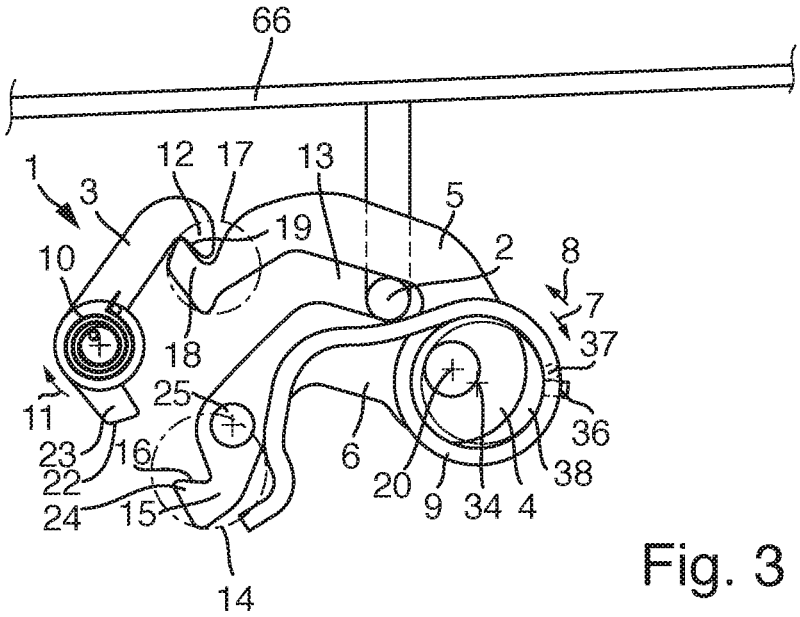
Figure 4:
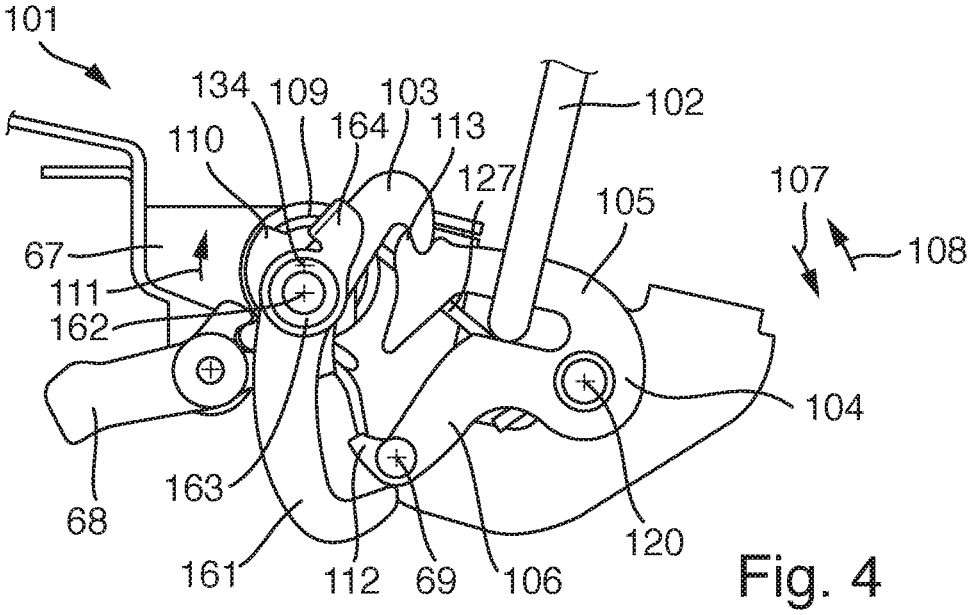
Figure 5:
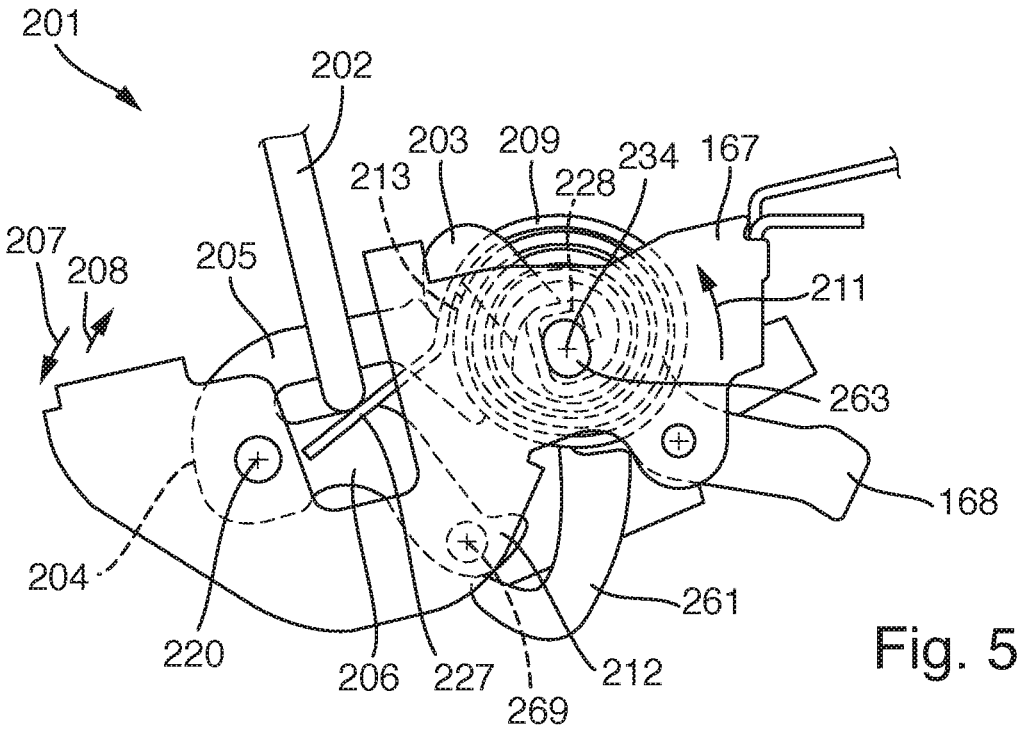
Figure 6:
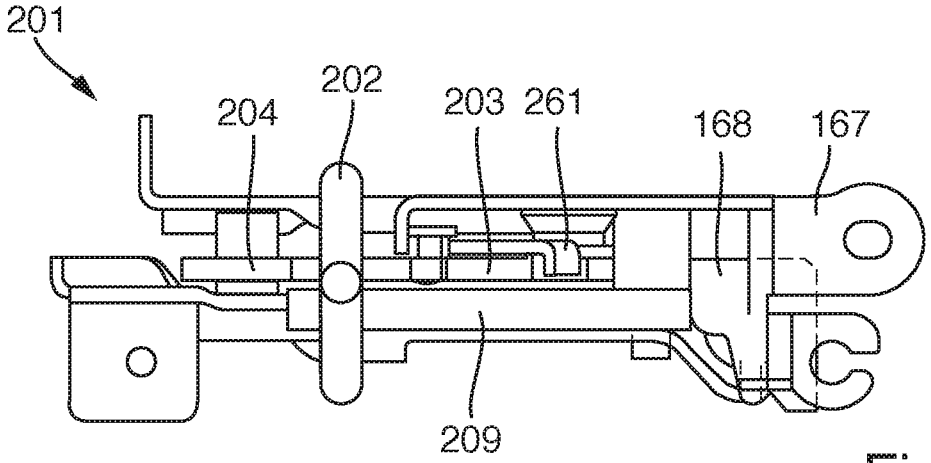

These show in:

FIGS. 1*a* to 1*f* a sectional view of a safety device during an opening process;

FIGS. 2*a* to 2*e* a sectional view of a safety device according to FIG. 1 *a* during a closure process;

FIG. 3 the safety device according to FIG. 1 *a* with a front hood arranged on a lock holder;

FIG. 4 a sectional view of a further safety device;

FIG. 5 a sectional view of a further safety device;

FIG. 6 a top view of a safety device according to FIG. 5.

FIG. 1*a* to 1*f* and FIG. 2*a* show a safety device 1 for a motor vehicle during an opening process. FIG. 1*a* shows a safety device 1 with a lock holder 2, a pawl 3 and a rotary latch 4. The rotary latch 4 has a load arm 5, a catch arm 6, an opening direction of rotation 7, a closing direction of rotation 8, a pre-latching position and a main ratchet position, where the rotary latch 4 in FIG. 1 *a* assumes the main ratchet position. Furthermore, the safety device 1 has a rotary latch spring 9 which is tensioned in the closure direction 8 of the rotary latch and acts on the rotary latch 4 in the opening direction of rotation 7. The rotary latch spring 9 has a fixed end 36, which is braced on a static support 37 of the safety device 1. The fixed end 36 advantageously extends to a bearing socket 38 and surrounds the bearing socket 38, preferably such that the fixed end 36 is immobile in relation to the pivot axis 34 of the rotary latch spring 9. The rotary latch spring 9 has a leg which has an almost horizontal section in the main ratchet position shown in FIG. 1*a* which lies adjacent to the lock holder. Especially advantageously, the horizontal section of the leg borders a coil of the rotary latch spring 9. FIG. 1 *a* furthermore shows that the section of the leg in the main ratchet position includes an angle of approximately 12 degrees with a horizontal line in image plane of FIG. 1*a*, i.e. is aligned almost horizontally. The pawl 3 has a pawl spring 10 which acts on the pawl 3 into a locking direction of rotation 11. Furthermore, the pawl 3 has a ratchet nose 12 which secures the rotary latch 4 in the main ratchet position of the rotary latch 4 shown in FIG. 1 *a* against rotating in an opening direction of rotation 7.

The catch arm 6 and the load arm 5 form a fork-shaped infeed section 13 of the rotary latch 4 which accommodates the lock holder 2. The load arm 5 and the catch arm 6 are formed at least partially arch-shaped in order to enable guidance of the lock holder 2 within the infeed section 13 during a closure movement and an opening movement of the rotary latch 4.

The catch arm 6 has a head area 14 with a bending tangent 15 in the direction of the opening direction of rotation 7 of the rotary latch 4, where the bending tangent 15 forms a pre-ratchet 16. In the pre-latching position of the rotary latch 4 shown in FIG. 1*e*, the pawl 12 encompasses the pre-ratchet 16, where the ratchet nose 12 secures the rotary latch 4 from rotation in the opening direction of rotation 7. Furthermore, the load arm 5 has a head area 17 with a bending tangent 18 in the direction of the opening direction of rotation 7 of the rotary latch 4, where the bending tangent 18 forms a main ratchet 19. In the main ratchet position of the rotary latch 4 shown in FIG. 1*a* the pawl 12 encompasses the main ratchet 19. In the main ratchet position of the rotary latch 4 the rotary latch spring 9 furthermore acts on the rotary latch 4 in the direction of the opening direction of rotation 7 by means of the lock holder 2, whereby the main ratchet 19 presses against the ratchet nose 12 of the pawl 3 and thus generates pressure on a contact surface of the ratchet nose 12, which additionally holds the pawl to the force acting by means of the pawl spring 10 in a locked position shown in FIG. 1*a*.

In the main ratchet position of the rotary latch 4, starting from the pawl 3 through the ratchet nose 12 and the main ratchet 19 *a* retaining force acts on the load arm 5, which counteracts a torque of the tensioned rotary latch spring 9, whereby a distance of the main ratchet 19 to a pivot axis 20 of the rotary latch 4 forms a lever arm of the retaining force. Equally, a lever arm of a retaining force which acts on the catch arm 6 by the pawl 3 in the pre-latching position of the rotary latch, formed by means of a distance of the pre-ratchet 16 to the pivot axis 20.

The head area 17 of the load arm 5 and the head area 14 of the catch arm 6 constitute the areas of the rotary latch 4 furthest from the pivot axis 20 of the rotary latch 4 in the embodiment shown in the figures so that the largest possible lever arms can respectively be provided for the retaining forces in the main ratchet position or the pre-latching position of the rotary latch 4. Thus, additional material on an external circumference of the rotary latch 4 can be dispensed with, in particular in the area of the catch arm 6, to form a pre-ratchet or a main ratchet in a comparatively similar distance to the pivot axis 20, as shown in the pre-ratchet 16 and the main ratchet 19 to the pivot axis 20.

The rotary latch 4 can be loosened by means of a rotation of the pawl 3 against the locking direction of rotation 11 to a release position from the pre-latching position and from the main ratchet position. If the load arm 5 or the catch arm 6 of the rotary latch 4 can be passed in the opening direction of rotation 7 on the ratchet nose 12 of the pawl, the pawl 3 is located in the release position.

In the main ratchet position of the rotary latch 4 especially advantageously a movement of the pawl 3 can be triggered from the locked position to the release position by means of an electrical drive. FIG. 1 *b* shows the pawl 3 in the release position in which the bending tangent 18 of the load arm 5 can be passed on the ratchet nose 12. In the release position of the pawl 3 the rotary latch spring 9 accelerates the lock holder 2 upwards, whereby the lock holder 2 lies directly adjacent on the load arm 5 of the rotary latch 4 and rotates the rotary latch 4 in the opening direction of rotation 7 by means of its movement upwards. A special embodiment can be provided for that the electrical drive moves the pawl 3 from the locked position for a short time and an effect of the electrical drive on the pawl 3 is canceled directly after reaching the release position of the pawl 3.

It is within the possible that a spring stiffness of the pawl spring 10 is adjusted to the spring stiffness of the rotary latch spring 9, such that during unsecuring of the rotary latch 4 ratcheting into the pre-latching position is ensured from the main ratchet position. Such an adjustment of the spring stiffness of the pawl spring 10 provides in particular for the pawl spring 10 exerting at least such a pivot acceleration on the pawl that the pawl 3 moves back from the release position in a timely manner into the locking position, before the catch arm 6 can pass the ratchet nose 12.

Figure 1C:
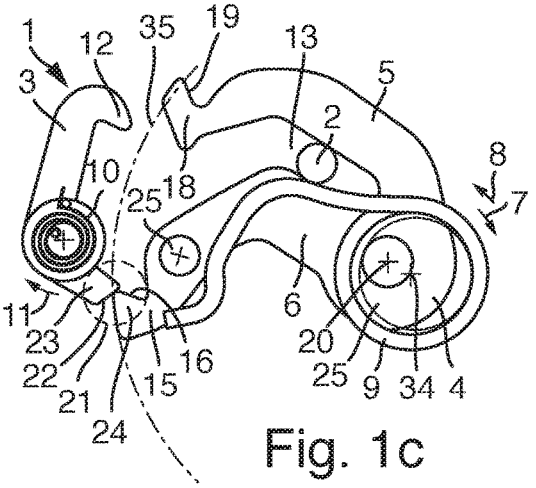

In addition or alternatively to this adjustment of the spring stiffness of the pawl spring 10, the safety device 1 can have a delay mechanism 21. The delay mechanism 21 is shown in FIG. 1*c* and formed as a stop surface 22 at one end of a boom 23 of the pawl 3 and a chock-shaped end 24 of the bending tangent 15 of the catch arm 6.

The delay mechanism 21 is configured such that in the release position of the pawl 3 and during rotation of the rotary latch 4 starting from the main ratchet position into the opening direction of rotation 7 a trajectory 35 of a tip of the chock-shaped end 24 intersects the stop surface 22 of the boom 23. During impacting of the chock-shaped end 24 on the stop surface 22 the rotation of the rotary latch 4 in the opening direction of rotation 7 is stopped. By stopping the rotary latch 4 it is possible for the pawl spring 10 to move the pawl 3 into the locking position, before the bending tangent 15 of the catch arm 6 can pass the ratchet nose 12. Compared to a variant in which the rotary latch 4 is not stopped by means of the delay mechanism 21, the pawl spring 10 can have smaller dimensions as more time is available to move the pawl 3 from the release position into the locked position by stopping of the rotary latch 4.

Figure 1D:
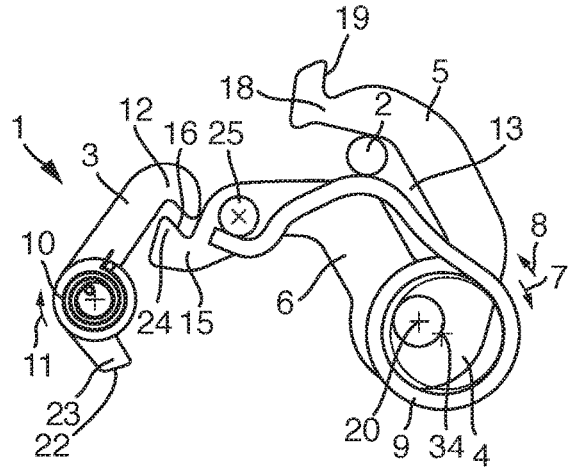

FIG. 1*d* shows the rotary latch 4 in an intermediate position between the main ratchet position and the pre-latching position in which the leg of the rotary latch spring 9 lies adjacent both to the lock holder 2 and also a bolt 25 which is arranged on the catch arm 6. After reaching this intermediate position of the rotary latch 4 the rotary latch spring 9 acts on the rotary latch 4 directly by means of the bolt 25 into the opening direction of rotation 7.

Figure 1E:
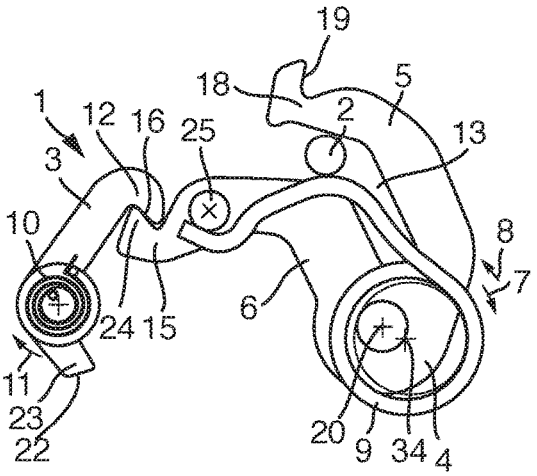
Figure 1F:
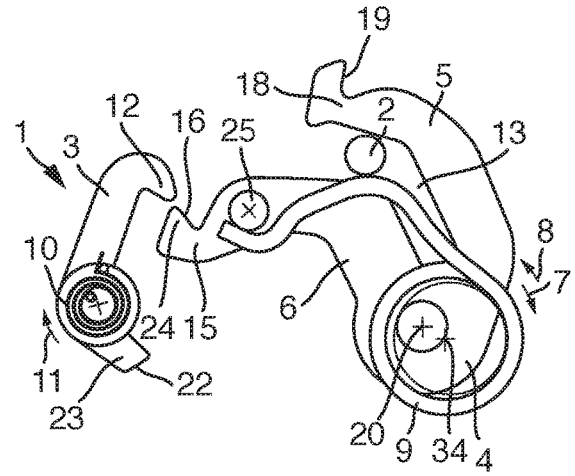
Figure 2A:
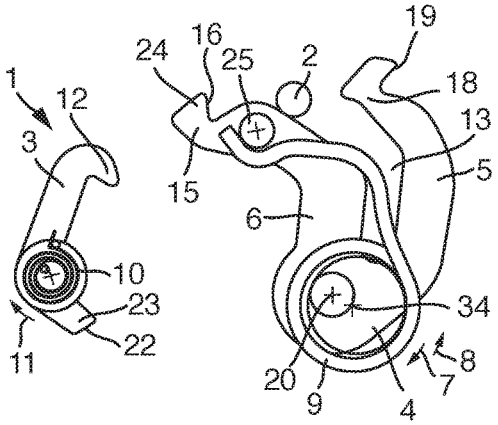
Figure 2B:
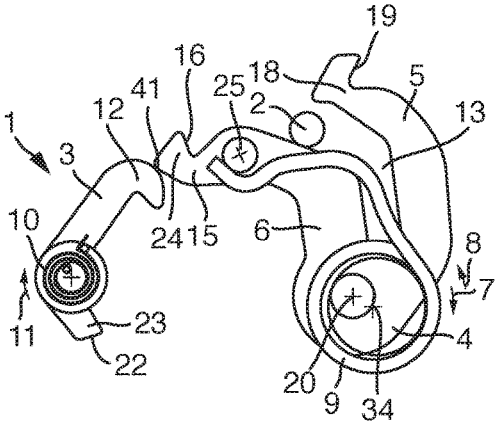

FIG. 1*e* shows the rotary latch 4 in the pre-latching position in which the ratchet nose 12 encompasses the bending tangent 15 of the head area 14 of the catch arm 6. In the pre-latching position, a rotation of the rotary latch 4 is blocked by means of the pawl 3 in an opening direction of rotation 7. The rotary latch 4 can be loosened from the pre-latching position by means of rotation of the pawl 3 from the locked position into the release position, as shown in FIG. 1*f*. Starting from the position shown in FIG. 1*f* of the rotary latch 4 the pawl spring 9 moves the rotary latch 4 further in the opening direction of rotation 7 to an open position of the rotary latch 4, whereby the lock holder 2 is lifted further. The open position of the rotary latch 4 is shown in FIG. 2*a*. According to the opening process of the safety device 1 shown in FIGS. 1*a* to 1*f* and 2*a*, the pawl spring 10 moves the pawl 3 back into the locked position.

FIG. 2*a* to 2*f* show a closure process of the safety device 1. Starting from the open position of the rotary latch 4 shown in FIG. 2*a* the lock holder 2 moves the rotary latch 4 into the closing direction of rotation 8 by means of the catch arm 6. During movement of the rotary latch 4 from the open position in the direction of the pre-latching position the bending tangent 15 of the head area 14 of the catch arm 6 impacts on a first active surface 41 of the pawl 3. The first active surface 41 extends along a back of the ratchet nose 12 to a tip of the ratchet nose 12. After impacting of the bending tangent 15 on the first active surface 41 the catch arm 6 shifts the pawl 3 starting from the locked position in the direction of the release position, whereby the catch arm 6 can pass on the ratchet nose 12.

Figure 2C:
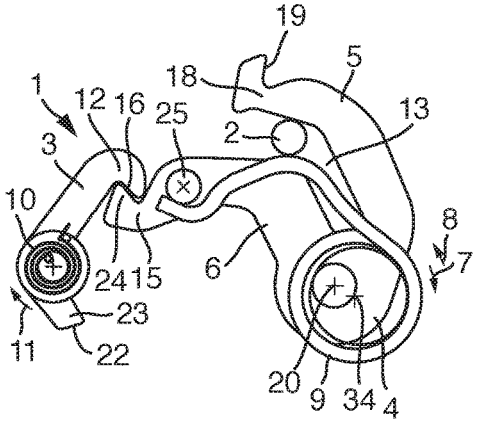

FIG. 2*c* shows the rotary latch 4 in the pre-latching position after the catch arm 6 has passed the ratchet nose 12 and the pawl 3 was moved by means of the pawl spring 10 into the locked position. This position can be assumed, for example, if a front hood on which the lock holder 2 is attached in an installed state of the safety device 1, was not depressed with sufficient force and the rotary latch 4 does not reach the main ratchet position. Ratcheting of the rotary latch 4 in the pre-latching position during a closure process of the safety device 1 prevents the rotary latch 4 from reaching the open position again and the front hood is released from the rotary latch 4 again.

Figure 2D:
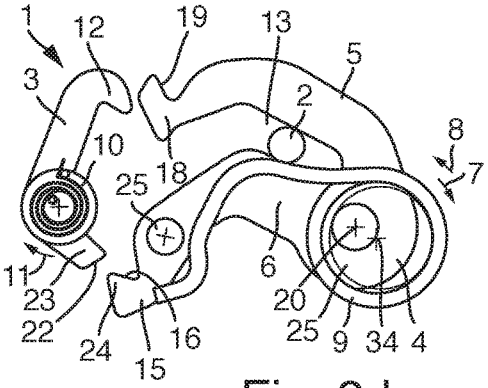
Figure 2E:
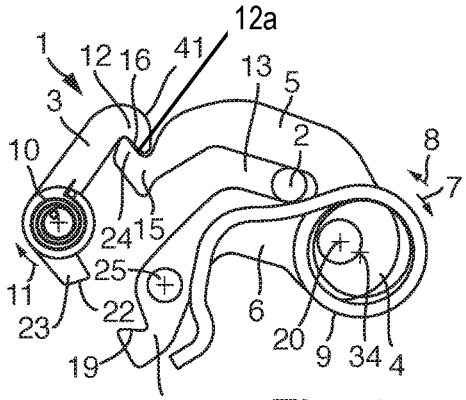

If, starting from the pre-latching position of the rotary latch 4 shown in 2 *c* the lock holder 2 is once again depressed, the bending tangent 18 impacts on the head area 17 of the load arm 5 on the first active surface 41 and rotates the pawl 3 into the release position shown in FIG. 2*d* in which the bad arm 5 can pass the ratchet nose 12. After the bad arm 5 has passed the ratchet nose 12, the pawl spring 10 moves the pawl 3 into the locking position in which the pawl 3 has a second active surface 12*a* and the ratchet nose 12 encompasses the bending tangent 15 of the head area 17 of the bad arm 5 and the rotary latch 4 assumes the main ratchet position, as shown in FIG. 2*e*.

In the embodiment of the safety device 1 shown in FIGS. 1*a* to 1*f* and 2*a* to 2*e*, the rotary latch spring 9 has a pivot axis 34, which is arranged in a displaced manner to a pivot axis 20 of the rotary latch 4. A lever arm which extends between the central point of the lock holder 2 and the pivot axis 34 of the rotary latch spring 9, and is enlarged by means of the displaced pivot axes 34 and 20 compared to a safety device in which the rotary latch spring 9 and the rotary latch 4 have a common pivot axis. In a different configuration, the rotary latch 4 and the rotary latch spring 9 have a common pivot axis. This has the advantage of a more compact design and weight saving.

FIG. 3 shows a front hood 66 arranged on the lock holder 2, as can be provided for, for example, in the safety device 1 located in a state installed in a motor vehicle. The safety device 1 is preferably arranged in a front area of the front hood 66. Alternatively, the safety device 1 can be arranged in a rear area of the front hood 66.

FIG. 4 shows a sectional view of a further configuration of a safety device 101 with a lock holder 102, a pawl 103 and a rotary latch 104, where the rotary latch 104 has a catch arm 106 with a pre-ratchet 112, a load arm 105 with a main ratchet 113, an opening direction of rotation 107, a closing direction of rotation 108, a pre-latching position and a main ratchet position and is located in the main ratchet position in FIG. 4. Apart from the lock holder 102, almost all parts of the safety device 101 are preferably arranged on a lock case 67, where the lock case 67 is installed in an installed state of the safety device 101 statically in a motor vehicle. This also preferably applies to the safety device 1. The safety device 101 furthermore has a rotary latch spring 109 with a leg 127 to eject the lock holder 102, which acts on the rotary latch 104 in the opening direction of rotation 107. The pawl 103 has a pawl spring 110 which acts on the pawl 103 in a locking direction of rotation 111. In the pre-latching position of the rotary latch 104, the pawl 103 encompasses the pre-ratchet and is thus ratcheted on the catch arm 106. In the main ratchet position of the rotary latch 104 the pawl 103 encompasses the main ratchet 113 and is thus ratcheted onto the load arm 105.

In contrast to the configuration of the safety device 1 shown in FIGS. 1*a* to 1*f*, 2*a* to 2*f* and FIG. 3, the lock holder 102 is arranged in the main ratchet position of the rotary latch 104 between a pivot axis 134 of the rotary latch spring 109 and a pivot axis 120 of the rotary latch 104. This has the advantage of a simpler embodiment compared to the configuration shown in FIG. 1*a*. The embodiment shown in FIG. 4 furthermore provides in a preferred variant for the rotary latch spring acting on the lock holder 102 directly during movement of the rotary latch 104 from the main ratchet position into the opening direction of rotation 107 to an open position in which the lock holder 102 is released by the rotary latch 104.

The safety device 101 furthermore has a blocking element 161 which has a blocking position and a release position. In the blocking position of the blocking element 161 the rotary latch 104 is blocked in the closing direction of rotation 108. In the release position of the blocking element 161, the rotary latch 104 is released from the blocking element 161 in the closing direction of rotation 108 and enables lowering of the lock holder 102. Movement of the blocking element 161 from the release position into the blocking position is controlled by means of the pawl 103. The safety device 101 also has a blocking spring element 163, where the blocking spring element 163 can, for example, be a pivot spring or an elastic connecting element between the pawl 103 and the blocking element 161 and enables indirect driving of the blocking element 161 by means of the pawl 103. Furthermore, the safety device 101 has a tappet 164 by means of which the blocking element 161 can be driven against the locking direction of rotation 111 by means of the pawl 103.

A possible variant of the embodiment shown in FIG. 4 can provide for the leg 127 having a curved section similarly to the leg of the rotary latch spring 9 of the embodiment shown in FIG. 1*a*, whereby a curvature of the section preferably varies along the leg, in particular is formed alternately concave and convex to the pivot axis 134 of the rotary latch spring 109.

Furthermore, the safety device 101 has a triggering lever 68 which interacts with a boom of the pawl 103. A rotation of the triggering lever 68 in the locking direction of rotation 111 causes rotation of the pawl 103 in contrast to the locking direction of rotation 111 in the direction of the release position of the pawl 103. The triggering lever 68 is can preferably be operated electrically to loosen the rotary latch 104 from the main ratchet position, for example by means of an electromotor, and on the other hand can be operated manually to loosen the rotary latch 104 from the pre-latching position.

FIG. 5 shows a sectional view of a further configuration of a safety device 201 with a lock holder 202, a pawl 203 and a rotary latch 204, whereby the rotary latch 204 has a catch arm 206 with a pre-ratchet 212, a load arm 205 with a main ratchet 213, an opening direction of rotation 207, a closing direction of rotation 208, a pre-latching position and a main ratchet position and is located in the main ratchet position. Apart from the lock holder 202, almost all parts of the safety device 201 are preferably arranged on a lock case 167, whereby the lock case 167 is installed in an installed state of the safety device 201 statically in a motor vehicle. The safety device 201 furthermore has a rotary latch spring 209 with a leg 227 to eject the lock holder 202, which acts in the opening direction of rotation 207 on the rotary latch 204. In a special embodiment a pawl spring can act on the pawl 203 in a locking direction of rotation 211. In the pre-latching position of the rotary latch 204 the pawl 203 encompasses the pre-ratchet 112 and is thus ratcheted on the catch arm 206. In the main ratchet position of the rotary latch 204 the pawl 203 encompasses the main ratchet 113 and is thus ratcheted onto the load arm 205.

In contrast to the configuration of the safety device 1 shown in FIGS. 1*a* to 1*f*, 2*a* to 2*f* and FIG. 3, the lock holder 202 is arranged in the main ratchet position of the rotary latch 204 between a pivot axis 234 of the rotary latch spring 209 and a pivot axis 220 of the rotary latch 204. This has the advantage of a simpler embodiment compared to the configuration shown in FIG. 1*a*. The embodiment shown in FIG. 5 furthermore provides in a variant for the rotary latch spring 209 acting on the lock holder 202 directly during movement of the rotary latch 204 from the main ratchet position into the opening direction of rotation 207 to an open position in which the lock holder 202 is released by the rotary latch 204.

The safety device 201 furthermore has a blocking element 261 which has a blocking position and a release position. In the blocking position of the blocking element 261 the rotary latch 204 is blocked in the closing direction of rotation 208. In the release position of the blocking element 261, the rotary latch 204 is released from the blocking element 261 in the closing direction of rotation 208 and enables lowering of the lock holder 202. Movement of the blocking element 261 from the release position into the blocking position is controlled by means of the pawl 203. The safety device 201 also has a blocking spring element 263, whereby the blocking spring element 263 can, for example, be a pivot spring or an elastic connecting element between the pawl 203 and the blocking element 261 and enables indirect driving of the blocking element 261 by means of the pawl 203.

A possible variant of the embodiment shown in FIG. 5 can provide for the leg 227 having a curved section similarly to the leg of the rotary latch spring 9 of the embodiment shown in FIG. 1*a*, where a curvature of the section preferably varies along the leg, in particular is formed alternately concave and convex to the pivot axis 234 of the rotary latch spring 209.

In contrast to the embodiment shown in FIG. 4, in the configuration of the pawl 203 shown in FIG. 5, the rotary latch spring 209 and the blocking element 261 are mounted around a common pivot axis 234, which enables a more compact design of the safety device 201 and saving of the pivot axis 134 of the rotary latch spring 109 shown in FIG. 4 and thus enables weight saving. Furthermore, the safety device 201 shown in FIG. 5 in contrast to the safety device 1 and the safety device 101 equipped with a spiral spring as a rotary latch spring 209 which can enable a narrower design of the safety device 201 compared to the safety devices 1 and 101, in which the rotary latch springs 9 and 109 are respectively executed as leg springs.

FIG. 6 shows a top view of a safety device 201 according to FIG. 5. In FIG. 6 it is apparent that the rotary latch spring 209 assumes approximately a breadth as the pawl 203 and the blocking element 261 together assume a breadth. The configuration of the rotary latch spring 209 as a spiral spring can in particular simplify common accommodation of the pawl 203, the rotary latch spring 209 and the blocking element 261 on the common pivot axis 234. Hereby, in particular the narrower design of the rotary latch spring 209 is hereby advantageous in particular as a spiral spring compared to a leg spring, because bearings can be arranged in a bearing pairing for the joint pivot axis 234 and thus the pivot axis 234 can be shorter and a higher bearing load of the pivot axis 234 is enabled to accommodate more than one component.

FIG. 5 furthermore shows that an internal end 228 of the rotary latch spring 209 lies against a connecting element 263 and is braced against this. The connecting element 263 advantageously combines the internal end 228 with the pawl 203 and the blocking element 261. A form-fitting connection between the internal end 228 and the pawl 203 is preferably provided for. By means of the connection between the internal end 228 and the pawl 203 the pawl 203 and the rotary latch spring 209 are preferably mutually supported, whereby additional components can be saved to support the pawl 203 and the rotary latch spring 209 and preferably also the pawl spring, whereby weight and necessary constructional space of the safety device 201 can be saved. A further embodiment, which is possible in combination with the aforementioned configuration can provide for the connecting element 263 being braced on the lock case 167.

The connecting element 263 preferably connects the blocking element 261 with the rotary latch spring 209 or with the pawl 203 elastically and in a force-fitting manner. In this configuration, the connecting element 263 can also assume the function of the blocking spring element 163 of the safety device 101. Thus, the connecting element 263 can on the one hand support the pawl 203 against the rotary latch spring 209 and, on the other hand, is formed as a blocking spring element. For example, the connecting element 263 can accommodate the pawl 203 and the rotary latch spring 209 on a first end and the blocking element 261 on a second end and be elastically formed between the two ends.

Furthermore, the safety device 201 has a triggering lever 168 which interacts with a boom of the pawl 203. A rotation of the triggering lever 168 in the locking direction of rotation 211 causes rotation of the pawl 203 in contrast to the locking direction of rotation 211 in the direction of the release position of the pawl 203. The triggering lever 168 can preferably be operated electrically to loosen the rotary latch 204 from the main ratchet position, for example by means of an electromotor, and on the other hand can be operated manually to loosen the rotary latch 204 from the pre-latching position.

The invention claimed is:

1. A safety device for a motor vehicle comprising:

a lock holder, a pawl, a rotary latch, and a rotary latch spring with a spring stiffness, where the rotary latch spring acts on the rotary latch in the opening direction of rotation, wherein the rotary latch has a load arm, a catch arm, an opening direction of rotation, a closing direction of rotation, a pre-latching position and a main latching position, wherein the pawl is latched in on the catch arm in the pre-latching position and is latched in on the load arm in the main latching position, wherein when the rotary latch is in the main latching position, the rotary latch spring has a leg with a section that is parallel or nearly parallel with a lengthwise axis of the motor vehicle, and wherein the section of the leg abuts the lock holder;

wherein the section of the leg of the rotary latch spring overlaps at least part of a surface of the rotary latch that extends in a rotational plane of the rotary latch, wherein the section of the leg extends over the rotary latch to engage the lock holder, and wherein when the rotary latch is in a main latching position, the lock holder is held between the load arm and the catch arm at a location between an axis of the rotary latch and an engagement point at which the pawl engages the rotary latch to hold the rotary latch in the main latching position.

2. The safety device according to claim 1, wherein the safety device has a pawl spring with a spring stiffness, where the pawl spring acts on the pawl in a closing direction of rotation, and a spring stiffness of the pawl spring which is adjusted to a spring stiffness of the rotary latch spring such that during unsecuring of the rotary latch from the main ratchet position, latching of the rotary latch into the pre-latching position is ensured.

3. The safety device according to claim 1, wherein the safety device has a delay mechanism to delay the rotary latch, where the delay mechanism ensures ratcheting of the rotary latch in the pre-latching position during rotation of the rotary latch in the opening direction of rotation starting from the main ratchet position.

4. The safety device according to claim 3, wherein the delay mechanism has a stop surface to stop the rotary latch.

5. The safety device according to claim 1, wherein the pawl has a first active surface and the catch arm has a countersurface and the first active surface interacts with the countersurface of the catch arm during rotation of the rotary latch in a closing direction of rotation before reaching the pre-latching position.

6. The safety device according to claim 5, wherein the load arm has a countersurface and the first active surface interacts with the countersurface of the catch arm during closure of the rotary latch before reaching the main ratchet position.

7. The safety device according to claim 6, wherein the pawl has a second active surface which interacts with the countersurface of the load arm during closure of the rotary latch before reaching the main ratchet position.

8. The safety device according to claim 1, wherein the rotary latch spring is formed as a spiral spring.

9. A method for opening a safety device according to claim 1, comprising the following steps:

deflecting the pawl from a locking position;

rotating the rotary latch starting from the main ratchet position in the opening direction of rotation;

delaying the rotary latch;

moving the pawl in the direction of the locking position; and ratcheting the rotary latch in the pre-latching position.

* * * * *